US009719337B2

(12) United States Patent
Menard et al.

(10) Patent No.: US 9,719,337 B2
(45) Date of Patent: Aug. 1, 2017

(54) ACCELERATION OF HEAVY OIL RECOVERY THROUGH DOWNHOLE RADIO FREQUENCY RADIATION HEATING

(71) Applicant: CONOCOPHILLIPS COMPANY, Houston, TX (US)

(72) Inventors: Wendell Peter Menard, Katy, TX (US); David Andrew Brown, Katy, TX (US); Chris Lehecka, Katy, TX (US)

(73) Assignee: ConocoPhillips Company, Houston, TX (US)

( * ) Notice: Subject to any disclaimer, the term of this patent is extended or adjusted under 35 U.S.C. 154(b) by 412 days.

(21) Appl. No.: 14/255,033

(22) Filed: Apr. 17, 2014

(65) Prior Publication Data

US 2014/0311739 A1 Oct. 23, 2014

Related U.S. Application Data

(60) Provisional application No. 61/813,533, filed on Apr. 18, 2013.

(51) Int. Cl.
*E21B 43/24* (2006.01)
*E21B 36/04* (2006.01)

(52) U.S. Cl.
CPC ..... *E21B 43/2408* (2013.01); *E21B 36/04* (2013.01)

(58) Field of Classification Search
CPC .. E21B 43/2408; E21B 36/04; E21B 43/2406; E21B 43/25; E21B 43/255
See application file for complete search history.

(56) References Cited

U.S. PATENT DOCUMENTS 3,522,848 A * 8/1970 New ..... E21B 43/2401 166/303
5,152,341 A 10/1992 Kasevich
8,443,887 B2 * 5/2013 Parsche ..... E21B 43/2401 166/302

(Continued)

OTHER PUBLICATIONS

Schlumberger Oilfield Glossary entry for "steam-assisted gravity drainage", accessed Jul. 14, 2016 via www.glossary.oilfield.slb.com.*

(Continued)

*Primary Examiner* — Blake Michener
(74) *Attorney, Agent, or Firm* — ConocoPhillips Company

(57) ABSTRACT

Heavy oil recovery using downhole radio frequency radiation heating accelerates SAGD thermal recovery processes. In one embodiment, one or more SAGD well pairs traverse a subterranean formation for recovering heavy oil. The SAGD well pairs each create a steam chamber which, over time, expands to allow each steam chamber to interact with one another and in this way, increases the recovery heavy oil from the formation. One or more antennas may be interposed between the steam chambers to introduce electromagnetic radiation into the formation to heat the fluids therein to accelerate expansion of the steam chambers, particularly where antennas are judiciously situated to optimize steam chamber expansion. Where an infill production well is present, the antennas may be situated to accelerate steam chamber communication with the infill production well. Advantages include lower cost, higher efficiencies, quicker and increased hydrocarbon recovery.

18 Claims, 12 Drawing Sheets

(56) References Cited

U.S. PATENT DOCUMENTS 8,689,865 B2 * 4/2014 Banerjee ..... E21B 43/2406 166/248
8,783,347 B2 * 7/2014 Trautman ..... H01Q 9/24 166/272.1
8,960,286 B2 * 2/2015 Banerjee ..... C10G 15/08 166/272.3
2003/0178191 A1 * 9/2003 Maher ..... C09K 8/592 166/65.1
2006/0283598 A1 * 12/2006 Kasevich ..... E21B 43/2401 166/302
2007/0289736 A1 12/2007 Kearl et al.
2008/0073079 A1 * 3/2008 Tranquilla ..... E21B 43/003 166/270.1
2009/0050318 A1 2/2009 Kasevich
2009/0200031 A1 8/2009 Miller et al.
2010/0078163 A1 * 4/2010 Banerjee ..... E21B 43/2408 166/248
2011/0259585 A1 * 10/2011 Banerjee ..... E21B 43/2406 166/272.3
2012/0061081 A1 * 3/2012 Sultenfuss ..... E21B 43/2408 166/303
2012/0118879 A1 * 5/2012 Rey-Bethbeder ... E21B 43/2401 219/679
2013/0008651 A1 1/2013 Trautman et al.
2013/0048277 A1 * 2/2013 Parsche ..... E21B 43/2406 166/272.1
2013/0153210 A1 * 6/2013 Menard ..... E21B 43/2408 166/248
2014/0027109 A1 * 1/2014 Al-Buraik ..... E21B 43/24 166/248
2014/0151028 A1 * 6/2014 Parsche ..... E21B 43/2401 166/248
2014/0216739 A1 * 8/2014 Brown ..... E21B 43/16 166/272.3

OTHER PUBLICATIONS

International Search Report. PCT/US14/34486. Dated Jul. 24, 2014.

* cited by examiner 110
111
112
150
120
150A
150B
150C
159

--PRIOR ART--

ACCELERATION OF HEAVY OIL RECOVERY THROUGH DOWNHOLE RADIO FREQUENCY RADIATION HEATING

CROSS-REFERENCE TO RELATED APPLICATIONS

This application is a non-provisional application which claims benefit under 35 USC §119(e) to U.S. Provisional Application Ser. No. 61/813,533 filed Apr. 18, 2013, entitled "ACCELERATION OF HEAVY OIL RECOVERY THROUGH DOWNHOLE RADIO FREQUENCY RADIATION HEATING," which is incorporated herein in its entirety.

FIELD OF THE INVENTION

The present invention relates generally to methods and systems for enhancing heavy oil recovery through downhole radio frequency radiation heating to accelerate SAGD thermal recovery processes.

BACKGROUND

The production of hydrocarbons from low mobility reservoirs presents significant challenges. Low mobility reservoirs are characterized by high viscosity hydrocarbons, low permeability formations, and/or low driving forces. Any of these factors can considerably complicate hydrocarbon recovery. Extraction of high viscosity hydrocarbons is typically difficult due to the relative immobility of the high viscosity hydrocarbons. For example, some heavy crude oils, such as bitumen, are highly viscous and therefore immobile at the initial viscosity of the oil at reservoir temperature and pressure. Many countries in the world have large deposits of bitumen oil sands, including the United States, Russia, and various countries in the Middle East. The world's largest deposits, however, occur in Canada and Venezuela. Oil sands are a type of unconventional petroleum deposit. The sands contain naturally occurring mixtures of sand, clay, water, and a dense and extremely viscous form of petroleum technically referred to as "bitumen," but may also be referred to as heavy oil. Indeed, such heavy oils may be quite thick and have a consistency similar to that of peanut butter or heavy tars, making their extraction from reservoirs especially challenging. Due to its high viscosity, these heavy oils are hard to mobilize, and they generally must be made to flow to produce and transport them. Indeed, such heavy oils are typically so heavy and viscous that they will not flow unless heated or diluted with lighter hydrocarbons. At room temperature, it is much like cold molasses.

As used herein, the term, "heavy oil" includes any heavy hydrocarbons having greater than 10 carbon atoms per molecule. Further, the term "heavy oil" includes heavy hydrocarbons having a viscosity greater than about 100 centipoise at reservoir conditions.

Conventional approaches to recovering heavy oils often focus on methods for lowering the viscosity of the heavy oil or heavy oil mixture so that the heavy oil may be mobilized and produced from the reservoir. One example of lowering the heavy oil viscosity includes heating the heavy oil. Such commonly used thermal recovery methods include a number of technologies, such as steam flooding, cyclic steam stimulation, and steam assisted gravity drainage (SAGD), which require the injection of hot fluids into the reservoir. A 100° F. increase in the temperature of the heavy oil in a formation can lower its viscosity by two orders of magnitude. Accordingly, heating formation heavy oils can dramatically improve the efficiency of heavy oil recovery.

U.S. Pat. No. 4,344,485 issued to Butler describes early embodiments of the steam assisted gravity drainage (SAGD) thermal recovery technique. Essentially, the SAGD method typically involves a pair of wellbores, a steam injection well and a production well. Steam is injected into the steam injection wellbore to introduce heat into the heavy oil reservoir which reduces the viscosity of the hydrocarbons therein, allowing the hydrocarbons to be produced through the production well. Although many variations exist, FIG. 10 illustrates one example of a SAGD heavy oil recovery system. In FIG. 10, a cross-sectional view of a heavy oil reservoir is shown depicting two SAGD well pairs in hydrocarbon reservoir 7. The first SAGD well pair comprises a first steam injection well 11A and a first production well 12A. The second SAGD well pair comprises a second steam injection well 11B and a second production well 12B. Operation of first steam injection well 11A in conjunction with first production well 12A creates first steam chamber 25A over time. Likewise, second steam chamber 25B is created over time by operation of second steam injection well 11B in conjunction with second production well 12B. As can be seen in FIG. 10, first steam chamber 25A and second steam chamber 25B are not yet fluidly coupled with one another. That is, first steam chamber 25A and second steam chamber 25B have not yet grown to a large enough extent to couple with one another. Over time, these two steam chambers 11A and 11B may grow to such an extent that they couple with one another to form combined steam chamber 26. In this way, more and more of the hydrocarbons in subterranean formation 7 are recovered and produced.

Infill production well 20 may be interposed between first steam chamber 25A and second steam chamber 25B to assist in recovering heavy oil between first steam chamber 25A and second steam chamber 25B. Eventually, given enough time, steam chamber 26 will grow to include within its boundaries infill production well 20. Once this occurs, infill production well 20 will then be able to recover the hydrocarbons between the two steam chambers 11A and 11B.

Generally however, the expansion of combined steam chamber 26 is partially a gravity-driven process due to the condensing of the steam which drains under the influence of gravity towards the first and second production wells 12A and 12B. Thus, as steam chamber expands, the angle θ shown in FIG. 10 becomes smaller. Consequently, because this expansion is in part gravity-driven, steam chamber 26 expands slower and slower the more the angle θ decreases. Accordingly, expansion of steam chamber 26 is known to be quite slow and take excessively long periods of time the closer steam chamber 26 approaches infill production well 20. Thus, a continuing disadvantage of this thermal recovery configuration is the long period of time required to establish steam chamber connectivity among SAGD well pairs and with their corresponding infill production wells, if any are present. Additionally, by the time communication is eventually established to infill production well 20, the remaining oil left to be produced is often too negligible to justify the installation of a costly infill production well.

Accordingly, enhanced methods for accelerating SAGD heavy oil thermal recovery methods are needed that address one or more disadvantages of the prior art, especially as relating to accelerating communication among SAGD well pairs and infill production wells if present.

SUMMARY

The present invention relates generally to methods and systems for enhancing heavy oil recovery through downhole radio frequency radiation heating to accelerate SAGD thermal recovery processes.

A method for enhancing heavy oil recovery by accelerating downhole fluid communication through radio frequency radiation heating comprises the steps of: (a) introducing a steam assisted gravity drainage (SAGD) well pair into a subterranean formation, wherein the SAGD well pair comprises a producing well and a steam injection well, wherein the subterranean formation comprises a hydrocarbon reservoir wherein the hydrocarbon reservoir comprises hydrocarbons; (b) introducing an infill producer well in proximity to the SAGD well pair, wherein an antenna extends along at least a portion of the infill producer well, wherein the antenna is operably connected to an energy source; (c) inducing radio frequency radiation in the antenna by way of the energy source; (d) introducing steam into the steam injection well to establish a steam chamber in the hydrocarbon reservoir and allowing the steam to continuously condense to form water; (e) allowing the radio frequency radiation to propagate into the hydrocarbon reservoir to heat the water therein to accelerate fluid communication between the steam chamber and the infill producer well; and (f) producing the hydrocarbons from the hydrocarbon reservoir through the infill producer well.

A method for enhancing heavy oil recovery by accelerating downhole fluid communication through radio frequency radiation heating comprises the steps of: (a) introducing a first SAGD well pair and a second SAGD well pair into a subterranean formation, wherein each SAGD well pair comprises a producing well and a steam injection well, wherein the subterranean formation comprises a hydrocarbon reservoir wherein the hydrocarbon reservoir comprises hydrocarbon; (b) introducing at least one infill producer well substantially in between the SAGD well pairs; (c) extending at least one antenna in proximity to the at least one infill producer well, wherein the at least one antenna is operably connected to an energy source; (d) inducing radio frequency radiation in the at least one antenna by way of the energy source; (e) introducing steam into each steam injection well of each SAGD well pair to establish a first steam chamber around the first SAGD well pair and a second steam chamber around the second SAGD well pair and allowing the steam to continuously condense to form water; (f) allowing the radio frequency radiation to propagate into the hydrocarbon reservoir to heat the water therein to accelerate fluid communication between the steam chambers and at least one infill producer well; and (g) producing the hydrocarbons from the hydrocarbon reservoir through at least one infill producer well.

A method for enhancing heavy oil recovery by accelerating downhole fluid communication through radio frequency radiation heating comprises the steps of: (a) introducing a steam assisted gravity drainage (SAGD) well pair into a subterranean formation, wherein the SAGD well pair comprises a producing well and a steam injection well, wherein the subterranean formation comprises a hydrocarbon reservoir wherein the hydrocarbon reservoir comprises hydrocarbons; (b) introducing a plurality of infill producer wells wherein each infill producer well is in proximity to the SAGD well pair or in proximity to an adjacent infill producer well; (c) introducing steam into the steam injection well to establish a steam chamber in the hydrocarbon reservoir and allowing the steam to continuously condense to form water; (d) sequentially extending an antenna in proximity to each of the infill producer wells, wherein the antenna is operably connected to an energy source; (e) during step (d), inducing radio frequency radiation in the antenna by way of the energy source; (e) allowing the radio frequency radiation to propagate into the hydrocarbon reservoir to heat the water therein to accelerate fluid communication between the steam chamber and each of the infill producer wells that is in proximity to the antenna during steps (d) and (e); and (f) producing the hydrocarbons from the hydrocarbon reservoir through one or more of the infill producer wells.

The features and advantages of the present invention will be apparent to those skilled in the art. While numerous changes may be made by those skilled in the art, such changes are within the spirit of the invention.

BRIEF DESCRIPTION OF THE DRAWINGS

A more complete understanding of the present disclosure and advantages thereof may be acquired by referring to the following description taken in conjunction with the accompanying figures, wherein.

Figures 1A, 1B, 1C, 1D:
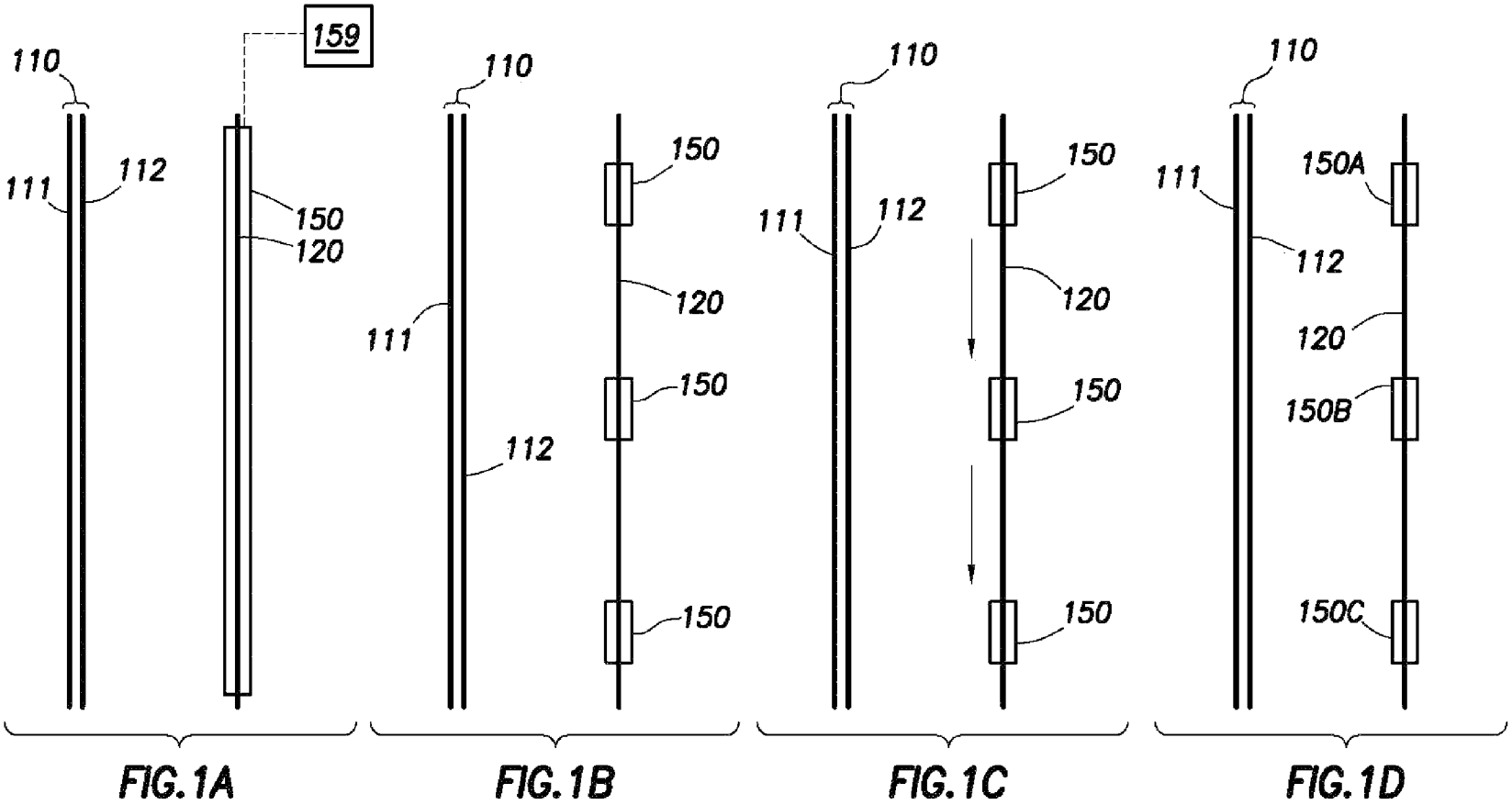
FIG. 1A illustrates a top view of a SAGD well pair in proximity to an infill producer well with an antenna along the length of the infill producer well.
FIG. 1B illustrates a top view of SAGD wellpair in proximity to an infill producer well with an antenna extending along a portion of the infill producer well.
FIG. 1C illustrates a top view of SAGD wellpair in proximity to an infill producer well with an antenna that is movable to multiple locations along the length of the infill producer well.
FIG. 1D illustrates a top view of SAGD wellpair in proximity to an infill producer well with multiple antennas situated at multiple locations along the length of the infill producer well.

While the present invention is susceptible to various modifications and alternative forms, specific exemplary embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION

The present invention relates generally to methods and systems for enhancing heavy oil recovery through downhole radio frequency radiation heating to accelerate SAGD thermal recovery processes.

Figure 10:
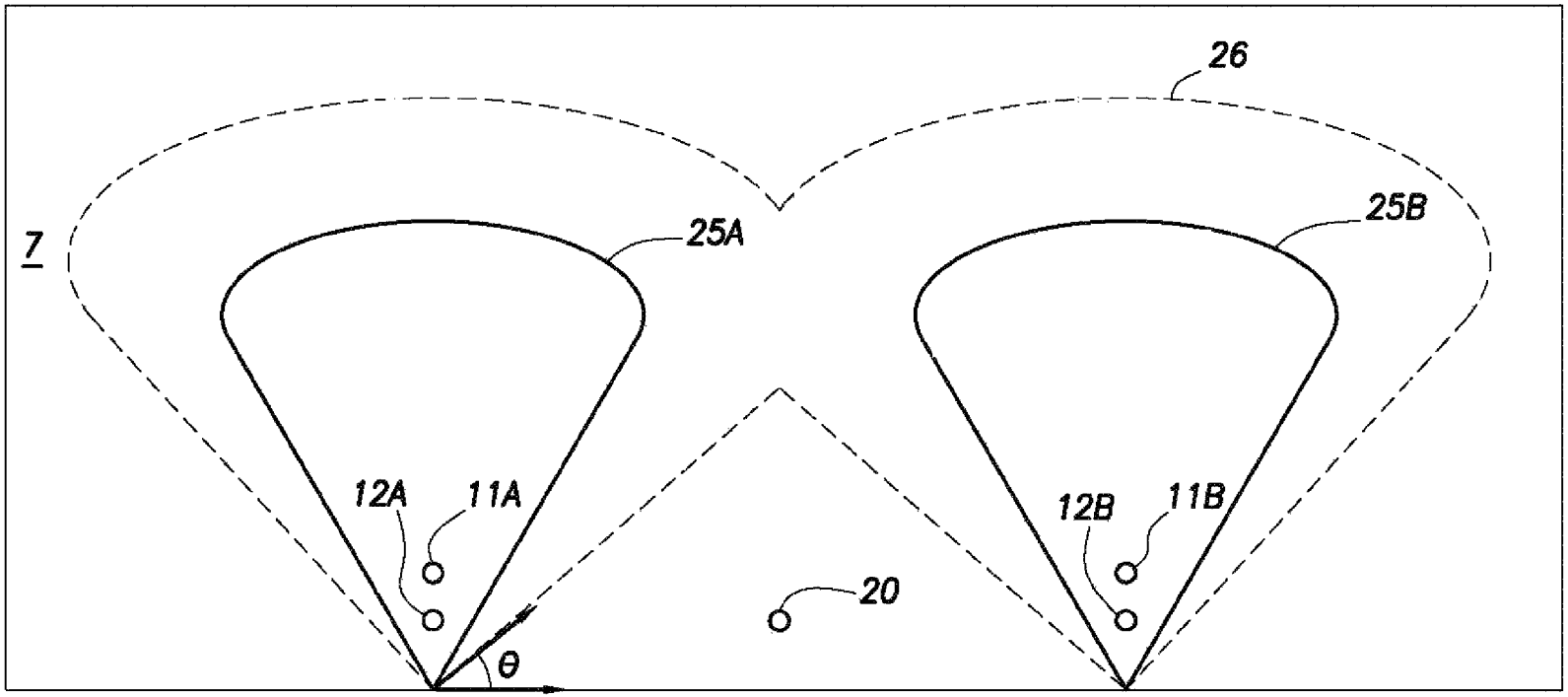
FIG. 10 illustrates a cross-sectional view of a heavy oil reservoir with a SAGD recovery system therein for recovering heavy oil from the heavy oil reservoir.

In certain embodiments, methods and systems are provided for accelerating heavy oil recovery from SAGD thermal recovery processes using radio frequency radiation. In one embodiment, one or more SAGD well pairs traverse a subterranean formation for recovering heavy oil. The SAGD well pairs each create a steam chamber which, when given enough time, will expand to an extent sufficient to allow each steam chamber to interact with one another and in this way, increase the recovery and production of heavy oil from the subterranean formation (similar to the process described above with reference to FIG. 10). One or more antennas may be interposed between the steam chambers to introduce electromagnetic radiation into the subterranean formation to heat the fluids therein to accelerate expansion of the steam chambers. In this way, the expansion of the steam chambers may be accelerated, particularly where the antennas are judiciously situated to optimize steam chamber expansion. Where infill production wells are present, the antennas may be situated so as to accelerate steam chamber communication with the infill production well.

Many variations are further described below. Advantages of the enhanced methods and systems described herein include one or more of the following advantages: quicker recovery and production of hydrocarbons when using SAGD thermal recovery methods, lower cost, higher efficiencies, and increased recovery of reservoir hydrocarbons. Other features, embodiments, and advantages will be apparent from the disclosure herein.

Reference will now be made in detail to embodiments of the invention, one or more examples of which are illustrated in the accompanying drawings. Each example is provided by way of explanation of the invention, not as a limitation of the invention. It will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations that come within the scope of the invention.

FIG. 1A illustrates a top view of a SAGD well pair with a producer well 111 and an injection well 112 in proximity to an infill producer well with an antenna along the length of the infill producer well. In this top view, the portion of the SAGD well pair 110 shown in FIG. 1A horizontally traverses a subterranean formation (more or less even with the Earth's surface). Operation of SAGD well pair 110 over time will generate a steam chamber about SAGD well pair 110. Eventually, the SAGD steam chamber about SAGD well pair 110 will expand to encompass infill producer well 120. Once the steam chamber is in fluid communication with infill producer well 120, hydrocarbons and condensate may be produced through infill producer well 120, and the steam chamber may be allowed to also expand about infill producer well 120. To accelerate expansion of the steam chamber towards infill producer well 120, antenna 150 may be located along the length of infill producer well 120. Antenna 150 may be coupled to an energy source 159. When activated, energy source 159 induces electromagnetic radiation in antenna 150, which then propagates through the subterranean formation. The electromagnetic radiation couples with the fluids in the subterranean formation and heats the fluids therein. In this way, communication between the steam chamber and infill producer well 120 is accelerated.

FIG. 1B shows a variation of the system depicted in FIG. 1A. FIG. 1B illustrates a top view of SAGD wellpair in proximity to an infill producer well with an antenna extending along a portion of the infill producer well. In this embodiment, antenna 150 may only extend along a portion or portions of infill producer well 120. Here, antenna 150 is shown at three possible locations along the length of infill producer well 120. In this embodiment, antenna 150 need not extend the entire length of infill producer well 120 and heating input may be localized to one or more areas as desired. In this way, energy is applied specifically to only those locations where acceleration of the steam chamber expansion is desired. Moreover, the cost of running an antenna the entire length of infill producer well 120 may be avoided.

FIG. 1C illustrates a top view of SAGD wellpair in proximity to an infill producer well with an antenna that is movable to multiple locations along the length of the infill producer well. Unlike FIG. 1B, antenna 150 is movable along at least a portion of the length of infill producer well 120. Here, antenna 150 is shown at three possible locations along the length of infill producer well 120. Antenna 150 may be activated to heat various regions about infill producer well 120 as desired.

FIG. 1D depicts yet another variation. FIG. 1D illustrates a top view of SAGD wellpair in proximity to an infill producer well with multiple antennas situated at multiple locations along the length of the infill producer well. Here, antennas 150A, 150B, and 150C are strategically placed at locations along the length of infill producer well 120 and are movable to heat regions along the length of infill producer well 120 as desired.

Figure 2B:
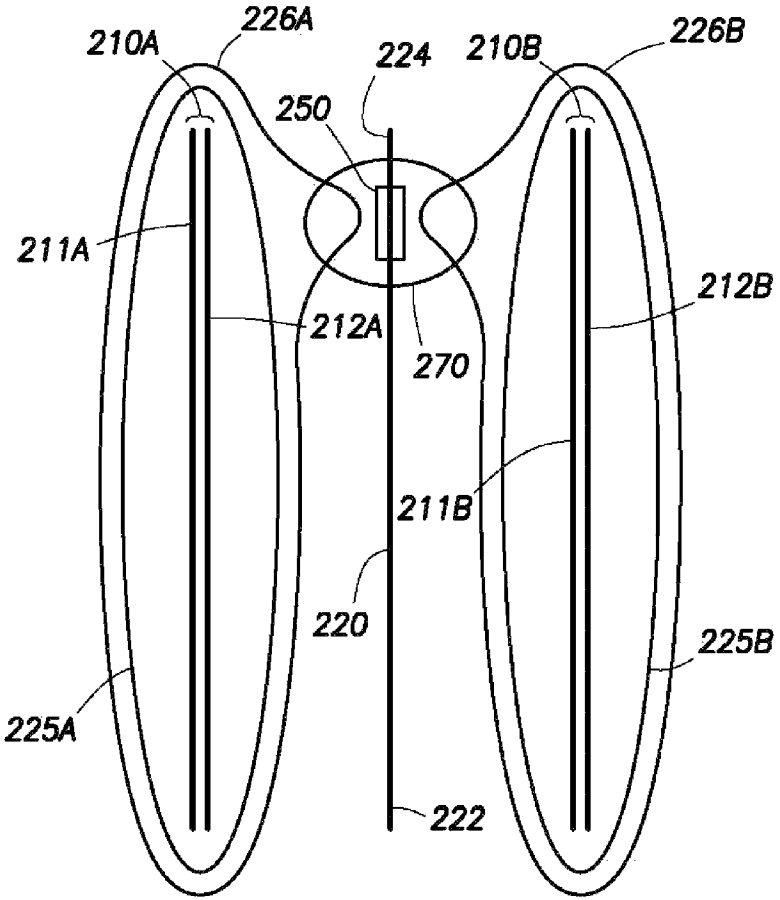
FIG. 2B illustrates the system of FIG. 2A after a time period of RF heating influence.
Figure 2A:
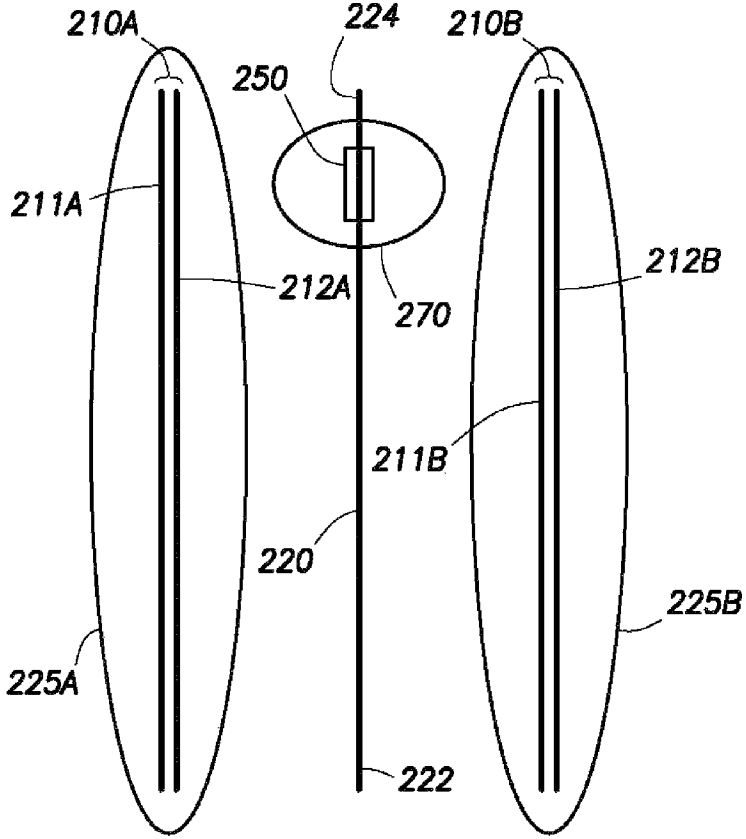
FIG. 2A illustrates a top view of an infill producer well situated between two SAGD well pairs with an antenna located in proximity to the toe of the infill producer well.

FIG. 2A illustrates a top view of an infill producer well situated between two SAGD well pairs with an antenna located in proximity to the toe of the infill producer well. SAGD well pair 210A comprises first steam injection well 211A and first production well 212A. Operation of SAGD well pair 210A produces steam chamber 225A about SAGD well pair 210A. Likewise, SAGD well pair 210B comprises second steam injection well 211B and second production well 212B. Similar to SAGD well pair 210A, operation of SAGD well pair 210B produces steam chamber 225B about SAGD well pair 210B. Infill producer well 220 is interposed between SAGD well pairs 210A and 210B for recovering hydrocarbons between SAGD well pairs 210A and 210B.

FIG. 2A depicts the horizontal portion of infill producer well 220. Typically, a vertical, or substantially deviated, well (not shown) extends into a subterranean formation before branching off to form the horizontal portion of infill producer well 220. The end of the horizontal portion of infill producer well 220 that first branches off from the vertical well is often referred to as the "heel" of infill producer well 220, while the other terminating end of infill producer well 220 is often referred to as the "toe" of infill producer well 220. Here, the heel of infill producer well 220 is indicated by reference numeral 222, whereas the toe of infill producer well 220 is indicated by reference numeral 224. In many cases, the toe region of the infill producer well is the last region around the infill producer well to establish fluid communication with adjacent steam chambers. Accordingly, one way to mitigate this specific problem is by introducing antenna 250 in proximity to toe 224 of infill producer well 220. Antenna 250, when activated, produces RF-heated region 270 about antenna 250. After a sufficient time period of RF-heating influence, RF-heated region 270 may expand sufficiently to establish fluid communication with first and second steam chambers 225A and 225B by forming expanded steam chambers 226A and 226B as is depicted in FIG. 2B. In this way, production from toe 224 of infill producer well 220 is accelerated more rapidly than would otherwise occur without the introduction of antenna 250.

Figure 3B:
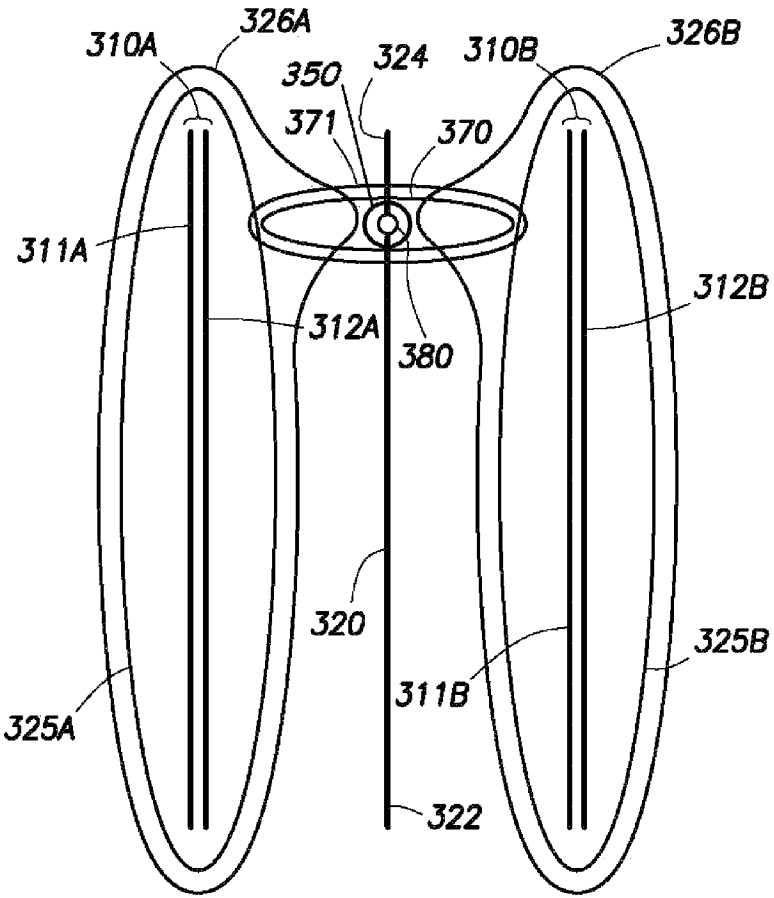
FIG. 3B illustrates the system of FIG. 3A after a time period of RF heating influence.
Figure 3A:
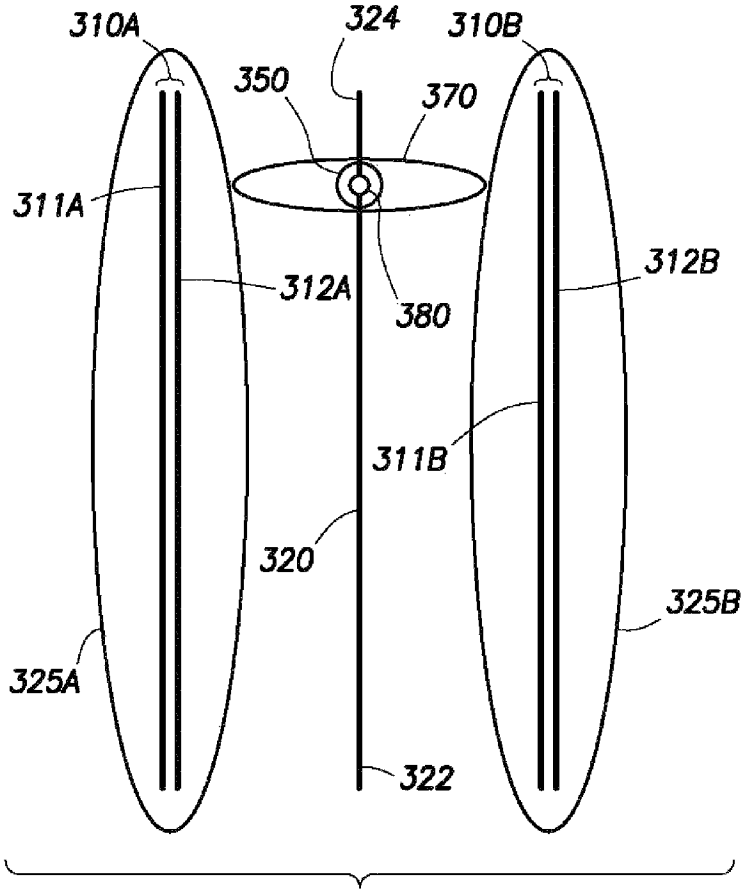
FIG. 3A illustrates a top view of an infill producer well situated between two SAGD well pairs with an antenna located in proximity to the toe of the infill producer well by way of a vertical well.

FIG. 3A illustrates a top view of an infill producer well situated between two SAGD well pairs with an antenna located in proximity to the toe of the infill producer well by way of a vertical well. SAGD well pair 310A comprises first steam injection well 311A and first production well 312A. Operation of SAGD well pair 310A produces steam chamber 325A about SAGD well pair 310A. Likewise, SAGD well pair 310B comprises second steam injection well 311B and second production well 312B. Similar to SAGD well pair 310A, operation of SAGD well pair 310B produces steam chamber 325B about SAGD well pair 310B. Infill producer well 320 is interposed between SAGD well pairs 310A and 310B for recovering hydrocarbons between SAGD well pairs 310A and 310B.

As in FIGS. 2A and 2B, it is desired to introduce an antenna near the toe of the infill producer well for accelerating expansion of steam chambers 325A and 325B towards communication with infill producer well 320. Here in FIGS. 3A and 3B, however, antenna 350 is introduced near toe 324 of infill producer well 320 by way of vertical well 380 to form RF-heated region 370. In some cases, it may be easier to simply drill another well near toe 324 of infill producer well 320 to situate antenna 350 at its desired destination. The heel 322 of the infill producer well is also shown for reference. As before, FIG. 3B illustrates the system of FIG. 3A after a time period of RF heating influence wherein steam chambers 325A and 325B expand to form expanded steam chambers 326A and 326B and wherein RF-heated region 370 expands to form expanded RF-heated region 371. In this way, communication between SAGD well pairs 310A and 310B and infill producer well 320 may be accelerated.

Figure 4B:
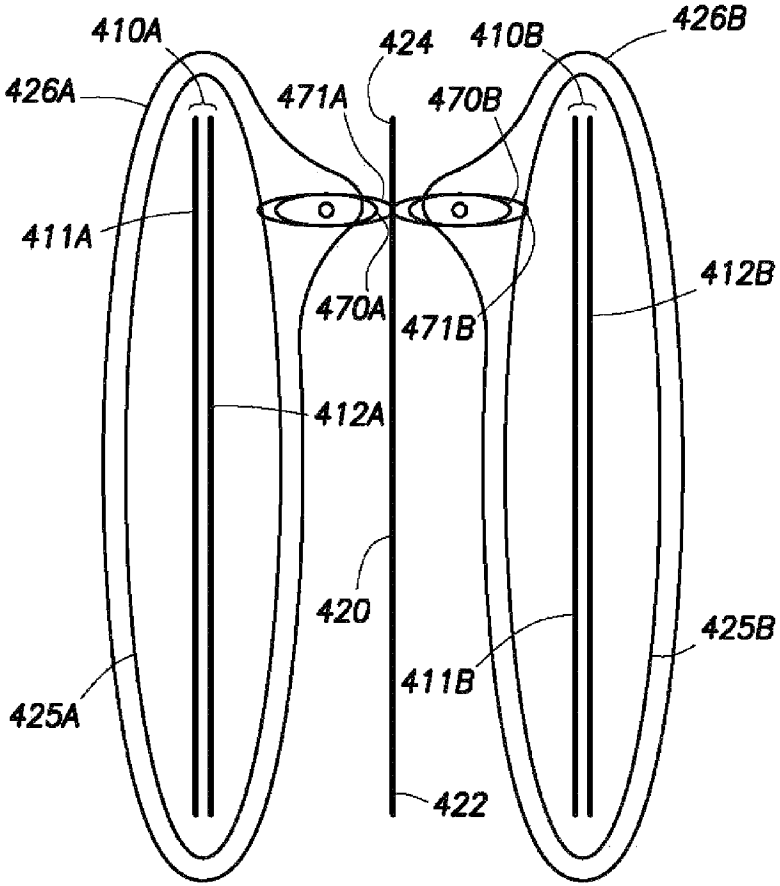
FIG. 4B illustrates the system of FIG. 4A after a time period of RF heating influence.
Figure 4A:
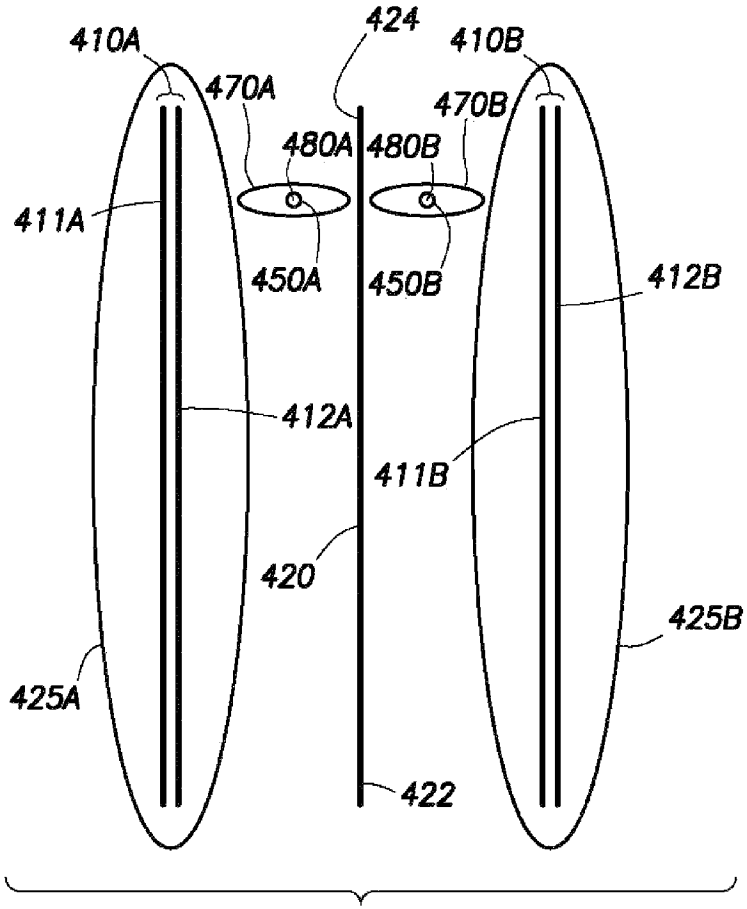
FIG. 4A illustrates a top view of an infill producer well situated between two SAGD well pairs with two antennas extending vertically near the toe of the infill producer well.

FIG. 4A illustrates another variation of the embodiment depicted in FIG. 3A. Here, FIG. 4A illustrates a top view of an infill producer well situated between two SAGD well pairs with two antennas extending vertically near the toe of the infill producer well. SAGD well pair 410A comprises first steam injection well 411A and first production well 412A. Operation of SAGD well pair 410A produces first steam chamber 425A about SAGD well pair 410A. Likewise, SAGD well pair 410B comprises second steam injection well 411B and second production well 412B. Similar to SAGD well pair 410A, operation of SAGD well pair 410B produces second steam chamber 425B about SAGD well pair 410B. Infill producer well 420 is interposed between SAGD well pairs 410A and 410B for recovering hydrocarbons between SAGD well pairs 410A and 410B. The heel of infill producer well 420 is indicated by reference numeral 422, whereas the toe of infill producer well 420 is indicated by reference numeral 424. Unlike FIG. 3A however where a single vertical well is introduced, here two vertical wells (i.e. first vertical well 480A and second vertical well 480B) are introduced to situate antenna 450A and 450B in proximity to infill producer well 420. After a time period of RF heating influence, steam chambers 425A and 425B will form expanded steam chambers 426A and 426B, and RF-heated regions 470A and 470B will form expanded RF-heated regions 471A and 471B as shown in FIG. 4B. In this way, communication may be accelerated between infill producer well 420 and SAGD well pairs 410A and 410B. As may be recognized with the benefit of this disclosure, any number of wells may be introduced into the subterranean formation to situate one or more antennas at desired locations to accelerate communication of steam chambers with one or more infill producer wells.

Figure 5B:
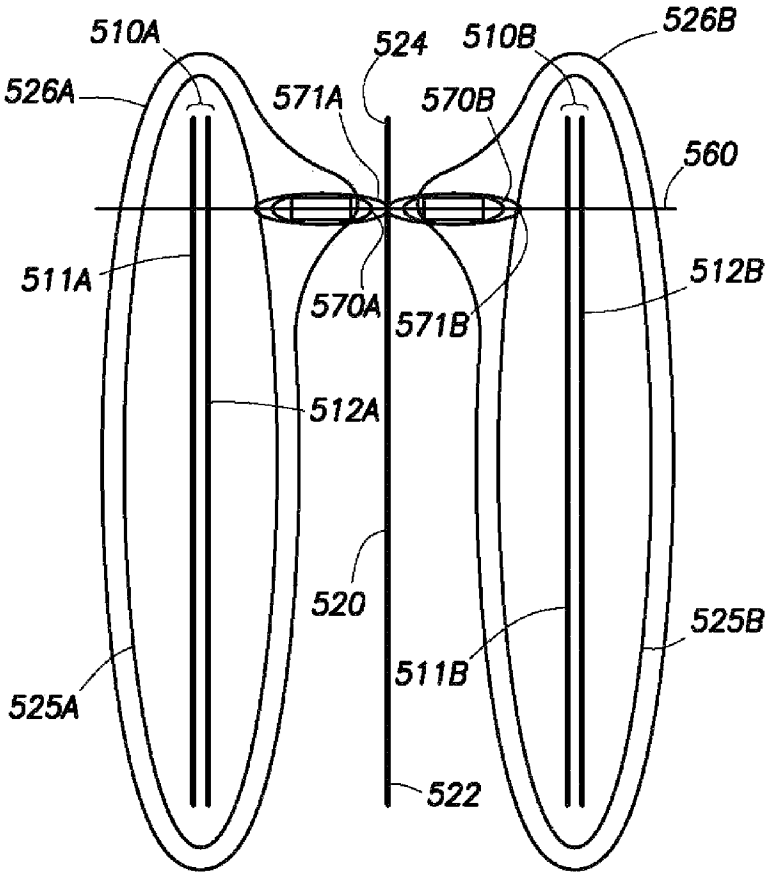
FIG. 5B illustrates the system of FIG. 5A after a time period of RF heating influence.
Figure 5A:
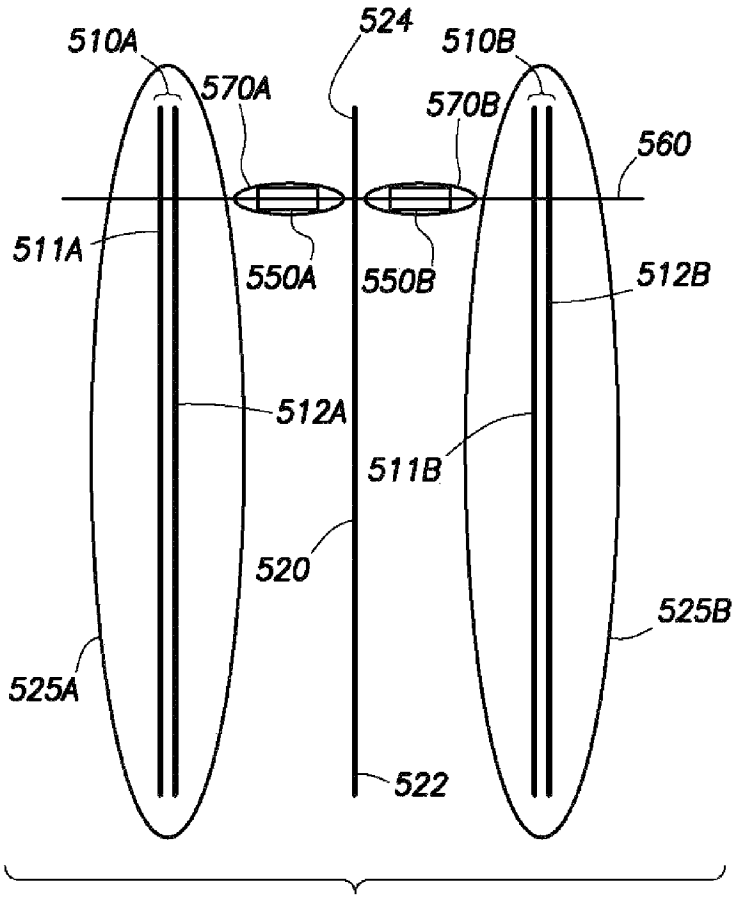
FIG. 5A illustrates a top view of an infill producer well situated between two SAGD well pairs with one or more antennas located near the toe of the infill producer well by way a horizontal cross well transverse to the infill producer well.

FIG. 5A illustrates a top view of an infill producer well situated between two SAGD well pairs with one or more antennas located near the toe of the infill producer well by way a horizontal cross well transverse to the infill producer well. SAGD well pair 510A comprises first steam injection well 511A and first production well 512A. Operation of SAGD well pair 510A produces first steam chamber 525A about SAGD well pair 510A. Likewise, SAGD well pair 510B comprises second steam injection well 511B and second production well 512B. Similar to SAGD well pair 510A, operation of SAGD well pair 510B produces second steam chamber 525B about SAGD well pair 510B. Infill producer well 520 is interposed between SAGD well pairs 510A and 510B for recovering hydrocarbons between SAGD well pairs 510A and 510B. The heel of infill producer well 520 is indicated by reference numeral 522, whereas the toe of infill producer well 520 is indicated by reference numeral 524. Unlike the previous embodiments however, here horizontal cross well 560 is introduced to situate antennas 550A and 550B in proximity to infill producer well 520. After a time period of RF heating influence, steam chambers 525A and 525B form expanded steam chambers 526A and 526B and RF-heated regions 570A and 570B form expanded RF-heated regions 571A and 571B. In this way, communication is established between infill producer well 520 and SAGD well pairs 510A and 510B. In some embodiments, antennas 550A and 550B may be movable to allow antennas 550A and 550B to expand or vary their region of RF-heating influence. In this way, connectivity between infill producer well 520 and steam chambers 525A and 525B may be accelerated.

Figure 6:
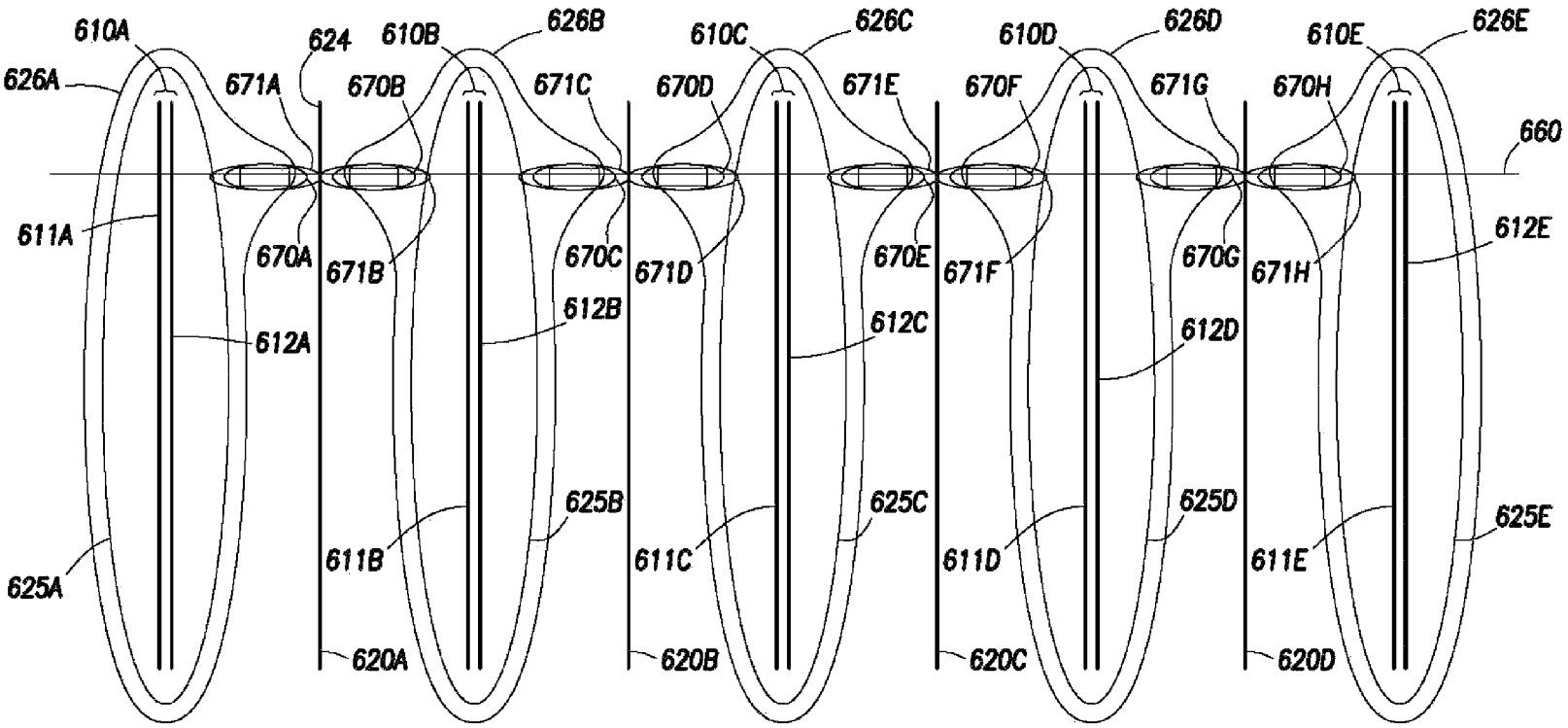
FIG. 6 illustrates a top view of the system of FIG. 5A successively repeated.

FIG. 6 illustrates a top view of the system of FIG. 5A successively repeated (using reference numerals analogous to those shown in FIGS. 5A and 5B). Here, horizontal cross well 660 traverses across SAGD well pairs 610A, 610B, 610C, 610D, and 610E. The SAGD well pairs 610A, 610B, 610C, 610D, and 610E comprise corresponding steam injection wells 611A, 611B, 611C, 611D, and 611E and corresponding production wells 612A, 612B, 612C, 612D, and 612E. Horizontal cross well 660 may be used to introduce one or more antennas 650A or 650B along the length of horizontal cross well 660 for heating one or more regions in between one or more of the SAGD well pairs (e.g. 610A, 610B, 610C, 610D, or 610E). In this way, expansion of steam chambers 625A, 625B, 625C, 625D, and/or 625E may be accelerated as shown in FIG. 6 to form expanded steam chambers 626A, 626B, 626C, 626D, and/or 626E. Likewise, RF-heated regions 670A, 670B, 670C, 670D, and/or 670E may expand to form expanded RF-heated regions 671A, 671B, 671C, 671D, and/or 671E. In this way, communication may be accelerated between the SAGD well pairs (e.g. 610A, 610B, 610C, 610D, or 610E) and their corresponding infill producer wells (e.g. 620A, 620B, 620C, or 620D).

Figure 7A:
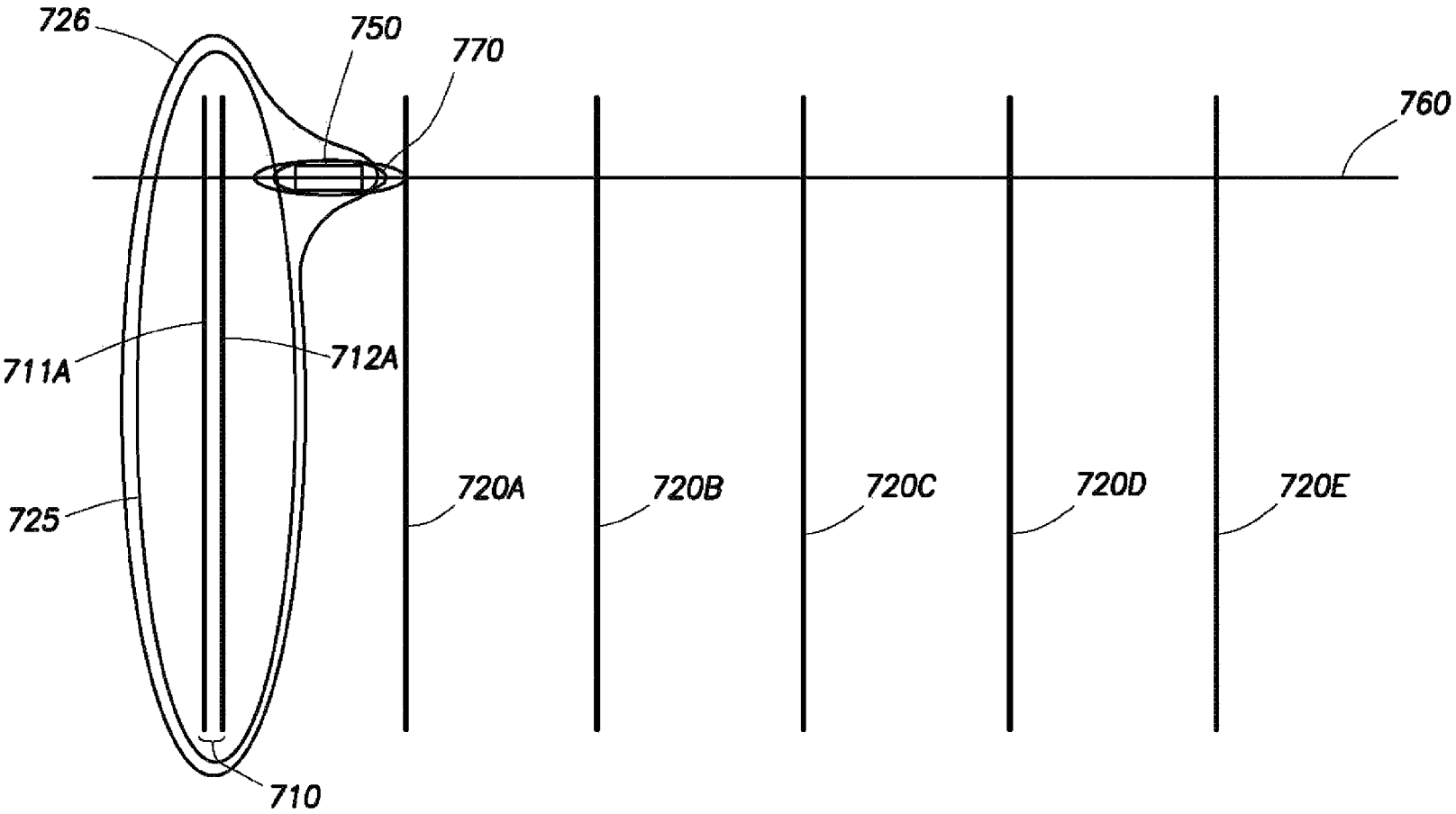
FIG. 7A illustrates a top view of a series of infill producer wells adjacent to a SAGD well pair with a horizontal cross well transverse to the infill producer well for running one or more antennas along the length of the horizontal cross well.
Figure 7B:
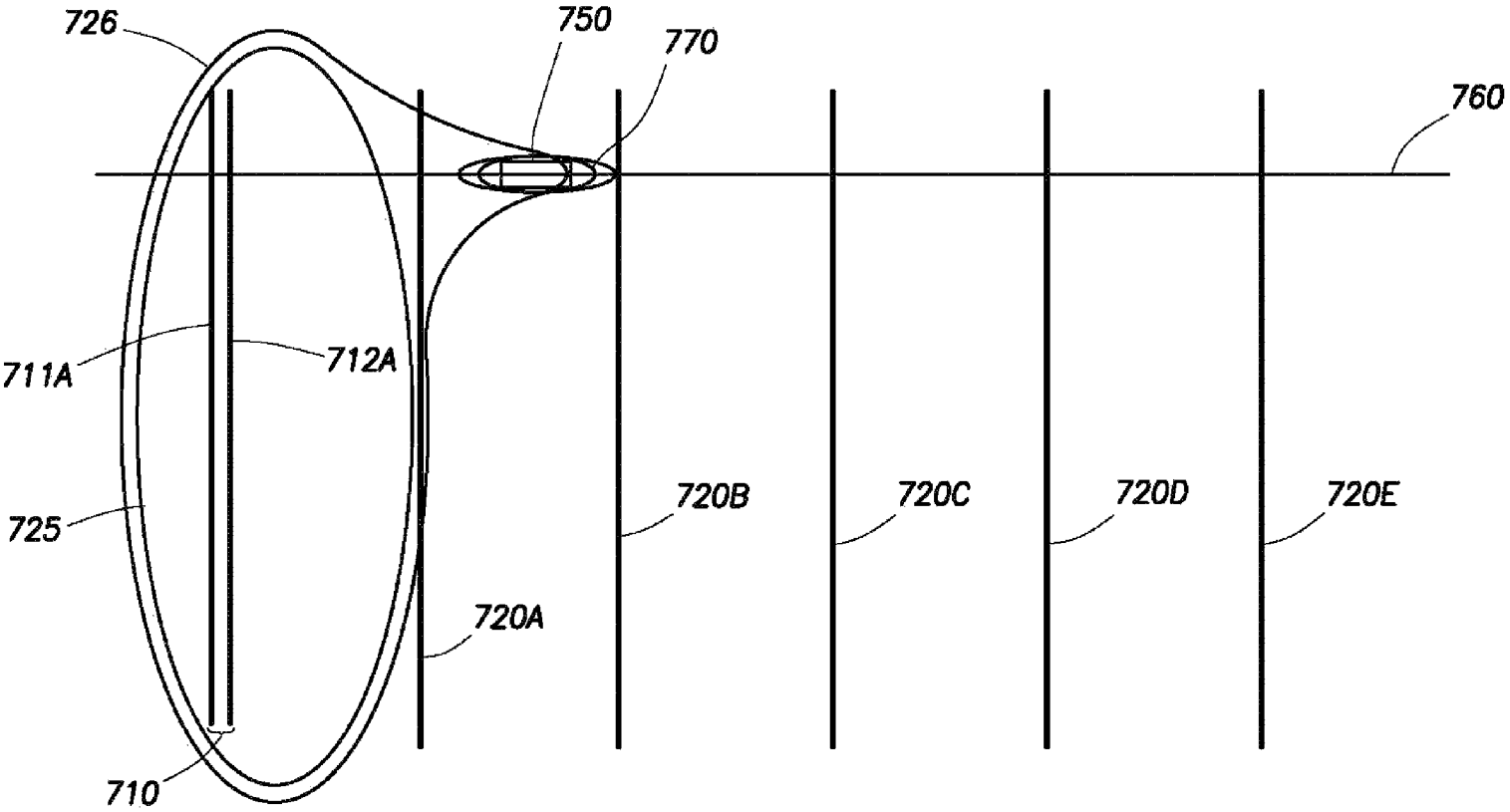
FIG. 7B illustrates the system of FIG. 7A after a first time period of RF heating influence.
Figure 7C:
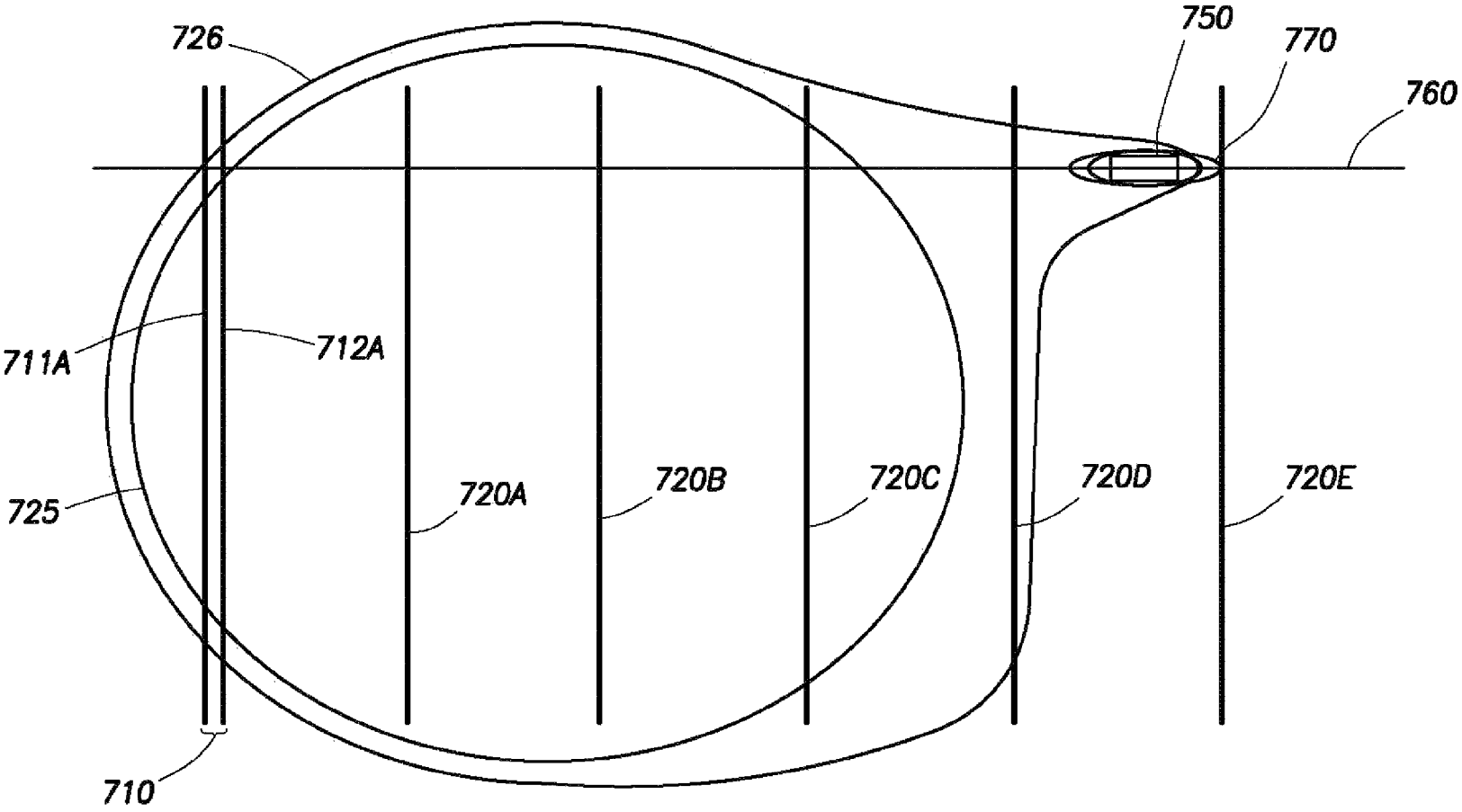
FIG. 7C illustrates the system of FIG. 7A after an additional time period of RF heating influence.

As a further variation upon the previous embodiments, FIG. 7A illustrates a top view of a series of infill producer wells adjacent to a SAGD well pair 710 with a producer well 711 and an injection well 712 and a horizontal cross well transverse to the infill producer well for running one or more antennas along the length of a horizontal cross well. Here, a series of infill producer wells 720A, 720B, 720C, 720D, and 720E are situated adjacent to SAGD well pair 710A. Similar to previously-disclosed embodiments, horizontal cross well 760 is used to locate antenna 750 in proximity to infill producer well 720A. Once steam chamber 725 has expanded to encompass infill producer well 720A under the influence of RF-heating from antenna 750, antenna 750 may be further situated closer to infill producer well 720B to further expand steam chamber 725 to form expanded steam chamber 726 to encompass infill producer well 720B. In like manner, antenna 750 may be extended along the length of horizontal cross well 760 to accelerate expansion of steam chamber 725 across infill producer wells 720C, 720D, and 720E by expanding RF-heated region 770 to form expanded RF-heated region 771. FIG. 7B illustrates the system of FIG. 7A after a first time period of RF heating influence, in which the infill producer well 720A has been brought into communication with steam chamber 725. FIG. 7C illustrates the system of FIG. 7A after a further additional time period of RF heating influence in which the infill producer wells (720A, 720B, 720C, 720D, and 720E) have been brought into communication with steam chamber 725. Although five infill producer wells are depicted in this embodiment, it is recognized that the invention herein may further include additional infill producer wells as desired. In this way, steam chamber 725 may be extended along any portion of the length of horizontal cross well 760.

Figure 8:
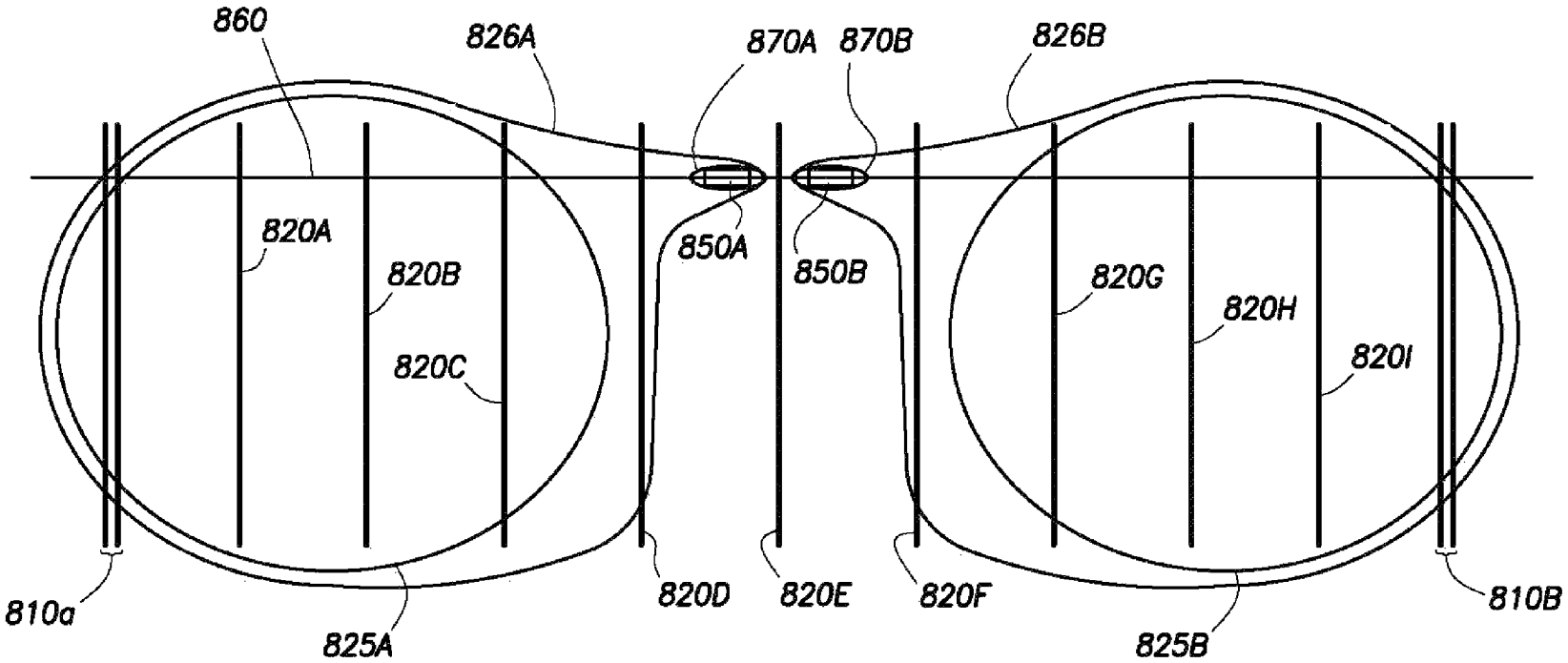
FIG. 8 illustrates a top view of a series of infill producer wells situated in between two SAGD well pairs with a horizontal cross well transverse to the infill producer wells for running one or more antennas along the length of the horizontal cross well.

FIG. 8 illustrates a further variation of the previous embodiments in which a top view of a series of infill producer wells is situated in between two SAGD well pairs with a horizontal cross well transverse to the infill producer wells for running one or more antennas along the length of the horizontal cross well. Here, SAGD well pairs 810A and 810B include a series of infill producer wells (820A, 820B, 820C, 820D, 820E, 820F, 820G, 820H, and 820I) interposed between SAGD well pairs 810A and 820B. Horizontal cross well 860 is introduced to situate one or more antennas 850A and 850B at various locations along the length of horizontal cross well 860. By judiciously locating antennas 850A and 850B, expansion of steam chambers 825A and 825B may be accelerated to form expanded steam chambers 826A and 826B through the use of RF-heated regions 870A and 870B so as to encompass infill producer wells 820A, 820B, 820C, 820D, 820E, 820F, 820G, 820H, and 820I.

Figure 9:
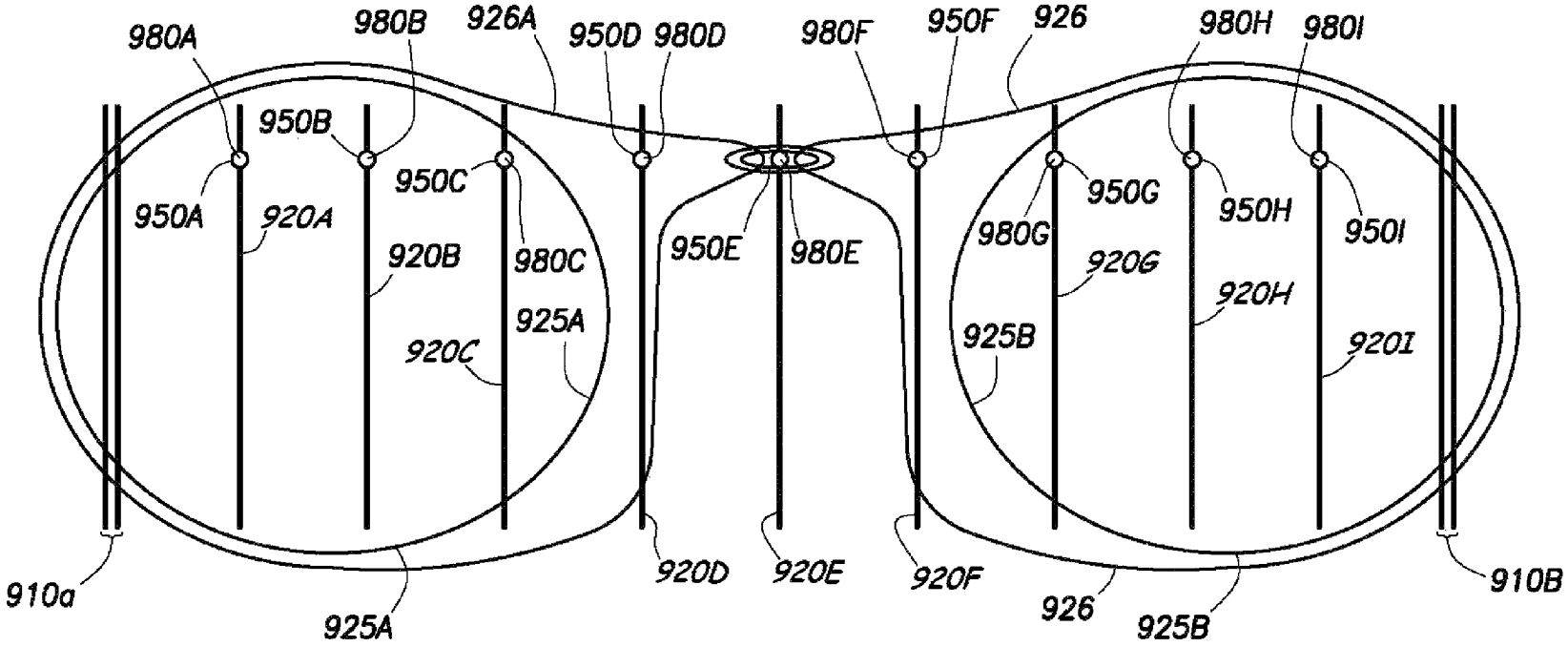
FIG. 9 illustrates a top view of a series of infill producer wells situated in between two SAGD well pairs with a series of vertical wells that may be used to extend one or more antennas in proximity to one or more of the infill producer wells.

FIG. 9 illustrates a top view of a series of infill producer wells 920A, 920B, 920C, 920D, 920E, 920F, 920G, 920H, and 920I situated in between two SAGD well pairs 910A & 910B with a series of vertical wells that may be used to extend one or more antennas in proximity to one or more of the infill producer wells. Here, a series of vertical wells 980A, 980B, 980C, 980D, 980E, 980F, 980G, 980H, and 980I are used to strategically situate antennas 950A, 950B, 950C, 950D, 950E, 950F, 950G, 950H, and 950I for accelerating expansion of steam chambers 925A and 925B to form expanded steam chamber 926 under the influence of antennas 950A, 950B, 950C, 950D, 950E, 950F, 950G, 950H, and 950I.

Where antenna placement is shown by the toe in the figures herein, this depiction is merely illustrative. Antennas may be situated anywhere in proximity to any portion of the length of the infill producer well the region that would benefit from RF-heating influence to accelerate steam chamber expansion as desired. Where desired, frequency and power output may be varied to improve RF-heating.

It is recognized that any of the elements and features of each of the devices described herein are capable of use with any of the other devices described herein without limitation. Furthermore, it is recognized that the steps of the methods herein may be performed in any order except unless explicitly stated otherwise or inherently required otherwise by the particular method.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations and equivalents are considered within the scope and spirit of the present invention. Also, the terms in the claims have their plain, ordinary meaning unless otherwise explicitly and clearly defined by the patentee.

What is claimed is:

1. A method for enhancing heavy oil recovery by accelerating downhole fluid communication through radio frequency radiation heating comprising the steps of:

a) introducing a steam assisted gravity drainage (SAGD) well pair into a subterranean formation, wherein the SAGD well pair comprises a producing well and a steam injection well, wherein the subterranean formation comprises a hydrocarbon reservoir wherein the hydrocarbon reservoir comprises hydrocarbons;

b) introducing an infill producer well in proximity to the SAGD well pair, wherein an antenna extends along at least a portion of the infill producer well, wherein the antenna is operably connected to an energy source;

c) inducing radio frequency radiation in the antenna by way of the energy source;

d) introducing steam into the steam injection well to establish a steam chamber in the hydrocarbon reservoir and allowing the steam to continuously condense to form water;

e) using a horizontal cross well to extend at least one antenna in proximity to the toe of the at least one infill producer well, wherein the horizontal cross well is substantially transverse to the infill producer well;

f) allowing the radio frequency radiation to propagate into the hydrocarbon reservoir to heat the water therein to accelerate fluid communication between the steam chamber and the infill producer well; and g) producing the hydrocarbons from the hydrocarbon reservoir through the infill producer well.

2. The method of claim 1 wherein the step of inducing radio frequency radiation in the antenna generates radio frequency radiation at a frequency from about 3 kHz to about 500 MHz.

3. The method of claim 2 wherein the step of inducing radio frequency radiation in the antenna generates radio frequency radiation is a frequency from about 100 kHz to about 100 MHz.

4. The method of claim 2 wherein the antenna has a length of about 5 meters to about 50 meters.

5. The method of claim 4 wherein the method further comprises the step of moving the antenna to a plurality of different locations along the infill producer well during step (f) to accelerate fluid communication between the steam chamber and the infill producer well along the infill producer well.

6. The method of claim 4 further comprising the steps of:

providing a plurality of antennas along the infill producer well, wherein the plurality of antennas are operably connected to the energy source; and inducing radio frequency radiation in the plurality of antennas by way of the energy source to accelerate fluid communication between the steam chamber and the infill producer well along the infill producer well.

7. The method of claim 4 wherein the infill producer well comprises a substantially horizontal section, wherein the substantially horizontal section comprises a heel section and a toe section, wherein the antenna extends in proximity to the toe section of the substantially horizontal section of the infill producer well.

8. A method for enhancing heavy oil recovery by accelerating downhole fluid communication through radio frequency radiation heating comprising the steps of:

a) introducing a first SAGD well pair and a second SAGD well pair into a subterranean formation, wherein each SAGD well pair comprises a producing well and a steam injection well, wherein the subterranean formation comprises a hydrocarbon reservoir wherein the hydrocarbon reservoir comprises hydrocarbon;

b) introducing at least one infill producer well substantially in between the SAGD well pairs;

c) extending at least one antenna in proximity to the at least one infill producer well, wherein the at least one antenna is operably connected to an energy source;

d) inducing radio frequency radiation in the at least one antenna by way of the energy source;

e) introducing steam into each steam injection well of each SAGD well pair to establish a first steam chamber around the first SAGD well pair and a second steam chamber around the second SAGD well pair and allowing the steam to continuously condense to form water;

f) using a horizontal cross well to extend the at least one antenna in proximity to the toe of the at least one infill producer well, wherein the horizontal cross well is substantially transverse to the infill producer well;

g) allowing the radio frequency radiation to propagate into the hydrocarbon reservoir to heat the water therein to accelerate fluid communication between the steam chambers and the at least one infill producer well; and h) producing the hydrocarbons from the hydrocarbon reservoir through the at least one infill producer well.

9. The method of claim 8 wherein the at least one antenna extends along at least a portion of the at least one infill producer well.

10. The method of claim 8 wherein the at least one infill producer well comprises a substantially horizontal section, wherein the substantially horizontal section comprises a heel section and a toe section, wherein the antenna extends in proximity to the toe section of the substantially horizontal section of the infill producer well.

11. The method of claim 8 wherein the method of claim 8 further comprises the step of using one or more vertical wells to extend the at least one antenna in proximity to a toe of the at least one infill producer well.

12. The method of claim 10 wherein the at least one antenna comprises a plurality of antennas, wherein the plurality of antennas comprises a first antenna and a second antenna, wherein the first antenna is disposed in proximity to a first region situated between the at least one infill producer well and the first SAGD well pair and wherein the second antenna is disposed in proximity to a second region situated between the at least one infill producer well and the second SAGD well pair.

13. The method of claim 8 wherein the first antenna is disposed in proximity to a first region situated between the at least one infill producer well and the first SAGD well pair and wherein the second antenna is disposed in proximity to a second region situated between the at least one infill producer well and the second SAGD well pair.

14. The method of claim 8 wherein the at least one infill producer well comprises a plurality of infill producer wells, each of which is situated between the first SAGD well pair and the second SAGD well pair.

15. The method of claim 14 further comprising the steps of:

extending a horizontal cross well into the subterranean formation that is substantially transverse to the at least one infill producer wells, wherein the at least one infill producer well comprises a plurality of infill producer wells, each of which is situated between the first SAGD well pair and the second SAGD well pair;

using the horizontal cross well to sequentially move the at least one antenna in proximity to the toe of each of the infill producer wells during step (f) so as to sequentially accelerate fluid communication between each infill producer well.

16. A method for enhancing heavy oil recovery by accelerating downhole fluid communication through radio frequency radiation heating comprising the steps of:

a) introducing a steam assisted gravity drainage (SAGD) well pair into a subterranean formation, wherein the SAGD well pair comprises a producing well and a steam injection well, wherein the subterranean formation comprises a hydrocarbon reservoir wherein the hydrocarbon reservoir comprises hydrocarbons;

b) introducing a plurality of infill producer wells wherein each infill producer well is in proximity to the SAGD well pair or in proximity to an adjacent infill producer well;

c) introducing steam into the steam injection well to establish a steam chamber in the hydrocarbon reservoir and allowing the steam to continuously condense to form water;

d) sequentially move an antenna in proximity to each of the infill producer wells, wherein the antenna is operably connected to an energy source;

e) during step (d), inducing radio frequency radiation in the antenna by way of the energy source;

f) allowing the radio frequency radiation to propagate into the hydrocarbon reservoir to heat the water therein to accelerate fluid communication between the steam chamber and each of the infill producer wells that is in proximity to the antenna during steps (d) and (e); and g) producing the hydrocarbons from the hydrocarbon reservoir through one or more of the infill producer wells.

17. The method of claim 16 wherein each infill producer well comprises a substantially horizontal section, wherein the substantially horizontal section comprises a heel section and a toe section, wherein step (d) further comprises sequentially extending the antenna in proximity to the toe of each infill producer well.

18. The method of claim 17 wherein step (d) further comprises extending the antenna in proximity to the toe of each infill producer well by way of a plurality of vertical wells, wherein each vertical well allows the antenna to be placed in proximity to at least one of infill producer wells.

* * * * *